US011148266B2

(12) United States Patent
Buffalo

(10) Patent No.: US 11,148,266 B2
(45) Date of Patent: Oct. 19, 2021

(54) WEDGE ANCHOR REMOVAL DEVICE

(71) Applicant: Alvin Buffalo, Pueblo, CO (US)

(72) Inventor: Alvin Buffalo, Pueblo, CO (US)

( * ) Notice: Subject to any disclaimer, the term of this patent is extended or adjusted under 35 U.S.C. 154(b) by 76 days.

(21) Appl. No.: 16/437,520

(22) Filed: Jun. 11, 2019

(65) Prior Publication Data

US 2019/0291250 A1 Sep. 26, 2019

Related U.S. Application Data

(60) Provisional application No. 62/717,068, filed on Aug. 10, 2018.

(51) Int. Cl.
*B25B 27/02* (2006.01)

(52) U.S. Cl.
CPC ..... *B25B 27/023* (2013.01)

(58) Field of Classification Search
CPC ..... B23P 19/06; B25B 27/023; B25B 23/103; Y10T 29/5383; Y10T 29/53843; Y10T 29/53848; Y10T 29/53878; Y10T 29/53943; Y10T 29/53952
USPC ..... 29/255, 252, 280, 278, 256, 263
See application file for complete search history.

(56) References Cited

U.S. PATENT DOCUMENTS 2,497,214 A * 2/1950 Dreyer ..... B25B 23/103 81/53.2
2,520,162 A * 8/1950 Morrison ..... B25B 27/062 29/263
3,740,814 A * 6/1973 Marshall ..... B25B 27/18 29/264
4,894,900 A * 1/1990 Rausfeisen ..... B25B 27/0035 29/256
5,416,963 A * 5/1995 Boynton ..... B25B 27/023 29/264
5,604,967 A * 2/1997 McMahon ..... B25B 27/023 29/263
8,490,263 B2 * 7/2013 Whitaker ..... B25B 27/062 29/264
8,931,153 B1 * 1/2015 Kimminau ..... B25B 13/48 29/256
9,718,156 B2 * 8/2017 Whitaker ..... B25B 27/023
9,844,866 B2 12/2017 Langdon, Jr.
2007/0110515 A1 5/2007 Appelman
2010/0003101 A1 1/2010 Ricketts
2010/0092921 A1 * 4/2010 Huffman ..... A61C 13/12 433/213
2010/0236040 A1 9/2010 Wallek
2013/0161038 A1 6/2013 Prunean
2013/0276300 A1 * 10/2013 Cha ..... B25B 27/023 29/700

* cited by examiner

*Primary Examiner* — Sarang Afzali
*Assistant Examiner* — Darrell C Ford
(74) *Attorney, Agent, or Firm* — Boudwin Intellectual Property; Daniel Boudwin

(57) ABSTRACT

A wedge anchor removal device. The wedge anchor removal device has an elongated cylindrical body. The elongated cylindrical body includes a bore centrally defined therein. The bore is sized to receive a rod. The rod has a first end disposed opposite a second end. The first end has a threaded interface. The threaded interface is configured to engage an anchor bolt. A nut is disposed on the second end of the rod.

10 Claims, 2 Drawing Sheets

WEDGE ANCHOR REMOVAL DEVICE

CROSS REFERENCE TO RELATED APPLICATIONS

This application claims the benefit of U.S. Provisional Application No. 62/717,068 filed on Aug. 10, 2018. The above identified patent application is herein incorporated by reference in its entirety to provide continuity of disclosure.

BACKGROUND OF THE INVENTION

The present invention relates to a wedge anchor removal device. Specifically, the present invention relates a device for removing a wedge anchor from concrete.

Wedge anchors are commonly used in construction for fastening materials to concrete surfaces. Wedge anchors consist of two pieces that form a single unit. The first piece is a substantially threaded rod that has a necked-down diameter, or conical space, that tapers outward towards the distal end of the substantially threaded rod. The second piece is a sleeve that is permanently assembled around the conical section of the rod. The distal end of the wedge anchor is inserted into a pre-drilled hole equal in diameter to the wedge anchor. The wedge anchor is secured in the hole when hammered into the hole.

Once a wedge anchor is secured upon the concrete surface, it becomes extremely difficult to remove. Additionally, removal or extraction of the wedge anchor is an extremely time-consuming process. Notably, if the wedge anchor hole was drilled incorrectly, the amount of time and effort put into removing the wedge anchor is increased. Traditionally, in removal, the anchor bolt must be cut off flush with the floor or other concrete surface. When the anchor bolt is cut off, the remainder of the wedge anchor is exposed. While exposed, the remainder of the wedge anchor can cause injuries, but also appears unsightly. Additionally, because of the remainder, the hole in the concrete surface cannot be patched. Thus, there is a defined need in the known art for a wedge anchor removal device that is effective and easy to use.

SUMMARY OF THE INVENTION

In view of the foregoing disadvantages inherent in the known types of methods and mechanisms for removing wedge anchors from concrete surfaces now present in the prior art, the present invention provides a wedge anchor removal device wherein the same can be utilized for providing convenience for the user when removing wedge anchors from concrete surfaces.

The device of the present invention comprises an elongated cylindrical body. The elongated cylindrical body includes a bore centrally defined therein. The bore is dimensioned to receive a rod. The rod has a first end disposed oppositely a second end. The first end has a threaded interface. The rod is hollow, defining an interior cavity. The threaded interface is configured to engage an anchor bolt. A nut is disposed on the second end of the rod.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
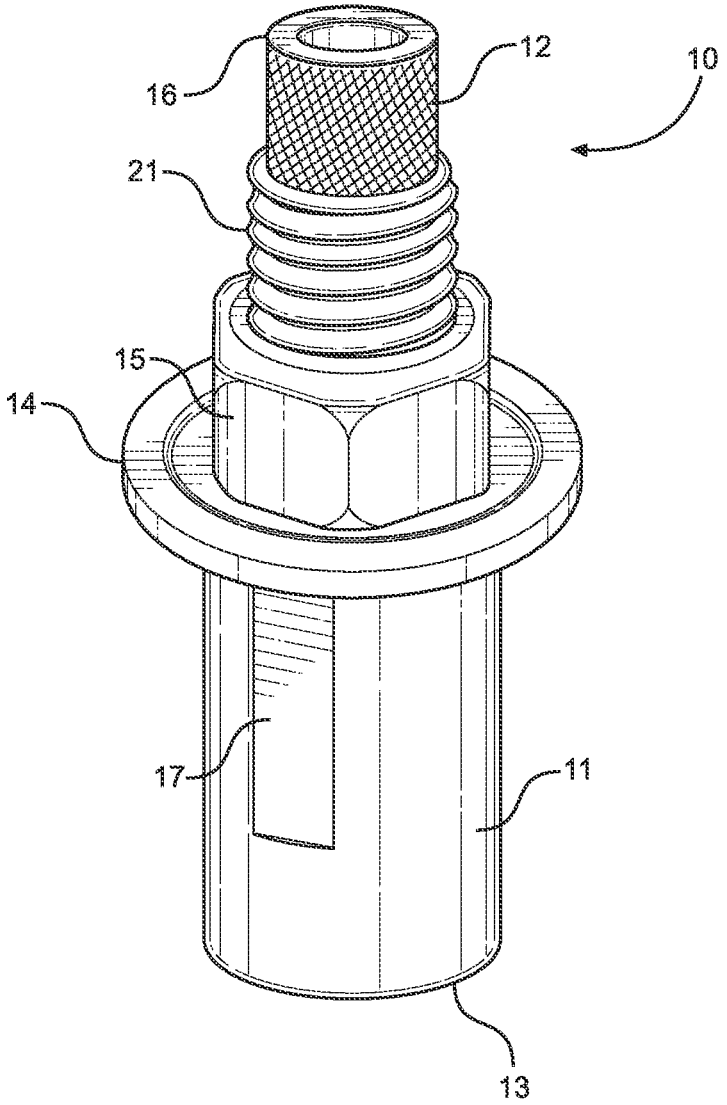
FIG. 1 shows a perspective view of an embodiment of the wedge anchor removal device.

Reference is made herein to the attached drawings. Like reference numerals are used throughout the drawings to depict like or similar elements of the wedge anchor removal device. The figures are intended for representative purposes only and should not be considered to be limiting in any respect.

Referring now to FIG. 1, there is shown a perspective view of an embodiment of the wedge anchor removal device. The wedge anchor removal device 10 comprises an elongated cylindrical body 11. The elongated cylindrical body 11 includes a bore centrally defined therein. In the illustrated embodiment, the elongated cylindrical body 11 is cylindrical, however, in alternate embodiments, the elongated body is of any suitable shape that allows for the user to grip with a hand or with a tool, such as a wrench. Furthermore, the elongated cylindrical body 11 is made of a resilient material. In one embodiment, the elongated cylindrical body 11 is made of steel, such that the durability of the wedge anchor removal device 10 is increased. In another embodiment, the elongated body 11 is made of aluminum, such that the wedge anchor removal device 10 is light weight and easily transportable.

A nut 15 is disposed on a second end 16 of the rod 12. The nut 15 is threadably engaged with a threaded interface 21 of the rod 12, such that rotation of the nut 15 rotates the rod 12 within the elongated cylindrical body 11. The nut 15 is configured to provide support to a user when the user is removing an anchor bolt with the wedge anchor removal device 10, by providing a means for a device, such as a wrench, to engage the rod 12 within the elongated cylindrical body 11. Additionally, increased force is exerted upon the rod 12 through engagement of the nut 15 rather than the rod 12 directly. As such, the nut 15 increases efficiency of the wedge anchor removal device.

In the illustrated embodiment, the wedge anchor removal device 10 further comprises a pair of opposing flattened portions 17 on opposing sides of the elongated cylindrical body 11. The pair of opposing flattened portions 17 provide convenience to a user, wherein the pair of opposing flattened portions 17 can be engaged by a device, such as a clamp or a pair of pliers. When the pair of opposing flattened portions 17 are engaged by a clamp or a pair of plyers, the position of the elongated cylindrical body 11 is secured, such that the rod 12 can be engaged without interference by the elongated cylindrical body.

Figure 2:
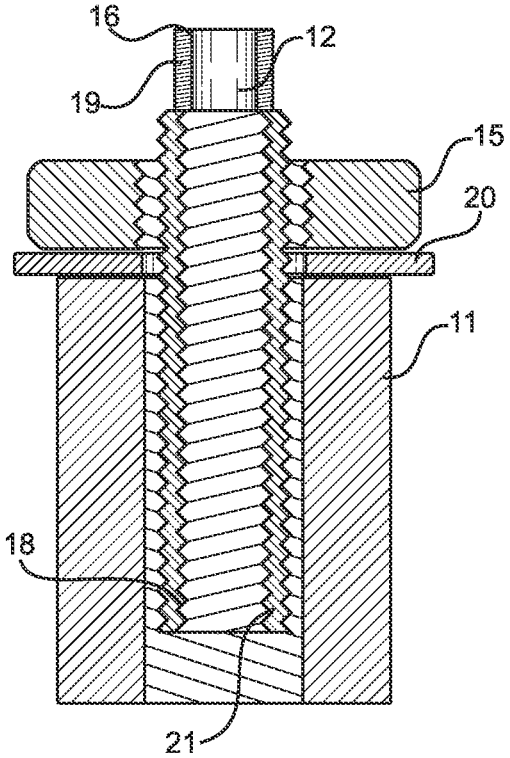
FIG. 2 shows a cross-sectional view of an embodiment of the wedge anchor removal device.

Referring now to FIG. 2, there is shown a cross-sectional view of an embodiment of the wedge anchor removal device. As shown, the rod 12 has a first end 18 disposed oppositely the second end 16. The first end 18 defines a threaded interface 21. The threaded interface 21 is configured to receive an anchor bolt. As shown, the threaded interface 21 is defined by an open end having an interior thread at the first end 18 of the rod 12.

In the illustrated embodiment, the second end 16 of the rod 12 defines a knurled interface 19. As shown, in a further embodiment, the knurled interface 19 is of a lesser circumference than a remaining portion of the rod 12. The knurled interface 19 creates an increased friction coefficient. As such, convenience is provided to the user in that the user can more easily and effectively rotate the rod 12. As a wedge anchor is being removed from a concrete surface, an increased amount of rotational force will allow for faster and easier removal.

In a further embodiment, the wedge anchor removal device further comprises a washer 20. The washer 20 is disposed in between the nut 15 and the elongated cylindrical body 11. When the nut 15 is engaged, such as by a wrench or a socket, the rotation of the nut 15 may cause damage to a top surface of the elongated cylindrical body 11. By providing a washer 20, this damage is negated as the rotation of the nut 15 will be against the washer 20 and the force exerted by the nut 15 will be absorbed by the washer 20.

Figure 3:
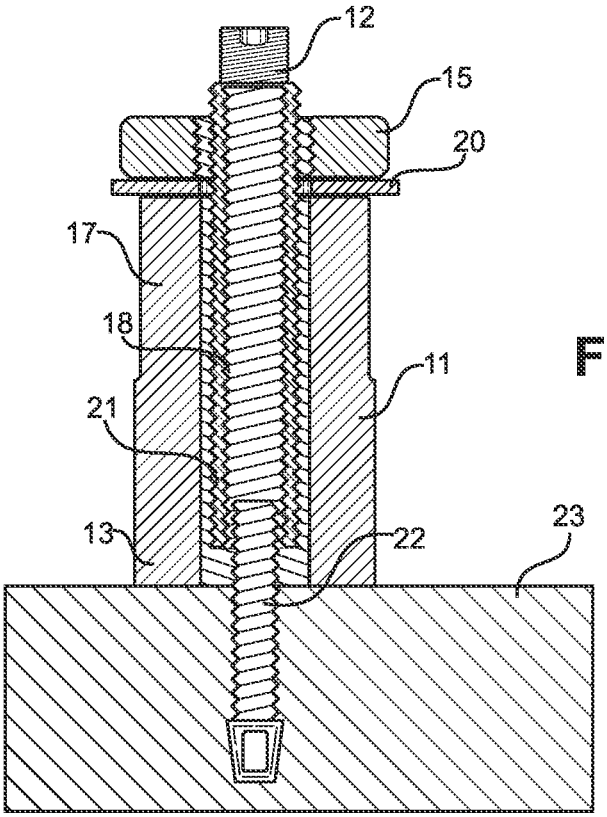
FIG. 3 shows a cross-sectional view of an embodiment of the wedge anchor removal device in use.

Referring now to FIG. 3, there is shown a cross-sectional view of an embodiment of the wedge anchor removal device in use. As a preliminary step to the removal of the wedge anchor 22, any washers or nuts are removed therefrom, such that these components will not interfere with operation of the wedge anchor removal device 10 and only the threaded end of the wedge anchor 22 is extended from a concrete surface 23.

In use, the rod 12 is engaged with the wedge anchor 22 via the threaded interface 21 of the rod 12 via rotation of the rod 12 in a first direction. Because of the rotation of the rod 12 in a first direction, the threaded interface 21 of the rod 12 will become engaged with the wedge anchor 22. As such, the threaded interface 21 is of a size corresponding to the threading of the targeted wedge anchor 22.

Once the rod 12 is engaged with the wedge anchor 22, the elongated cylindrical body 11 is engaged with the rod 12, until the proximal end 13 of the elongated cylindrical body 11 is brought into contact with the concrete surface 23. As such, the elongated cylindrical body 11 will spread out the force along a larger area of the concrete surface 23 because the elongated cylindrical body 11 defines a thickness greater than a thickness of the rod 12.

When the nut 15 is rotated, the rod 12 is rotated in the first direction, thus creating a pulling force upon the wedge anchor 22. In one embodiment, the nut 15 is rotated with a wrench, such that torque and pulling force upon the wedge anchor 22 are increased. As this pulling force is applied, the wedge anchor 22 will be removed from the concrete surface.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A wedge anchor removal device, comprising:
an elongated cylindrical body;
the elongated cylindrical body including a bore centrally defined therein;
the bore dimensioned to receive a rod;
the rod having a first end disposed opposite a second end;
the rod defining an interior cavity;
the interior cavity having a threaded interface;
the threaded interface configured to receive an anchor bolt;
a nut disposed on the second end of the rod;
wherein the second end of the rod defines a knurled interface at a terminal end thereof.

2. The wedge anchor removal device of claim 1, wherein the elongated cylindrical body further comprises a pair of opposing flattened portions disposed on an upper side portion of the elongated cylindrical body.

3. The wedge anchor removal device of claim 1, wherein the elongated cylindrical body is composed of steel.

4. The wedge anchor removal device of claim 1, wherein the elongated cylindrical body is composed of aluminum.

5. The wedge anchor removal device of claim 1, wherein the knurled interface comprises a lesser circumference than the rod.

6. The wedge anchor removal device of claim 1, wherein a washer is disposed between the nut and the elongated cylindrical body.

7. A wedge anchor removal device, comprising:
an elongated cylindrical body;
the elongated cylindrical body including a bore centrally defined therein;
a pair of opposing flattened portions disposed on an external surface of the elongated cylindrical body disposed on an upper side portion of the elongated cylindrical body;
the bore dimensioned to receive a rod;
the rod having a first end disposed opposite a second end;
the rod defining an interior cavity;
the interior cavity having a threaded interface;
the threaded interface configured to receive an anchor bolt;
a nut disposed on the second end of the rod;
a washer disposed between the nut and the elongated cylindrical body;
the second end of the rod defining a knurled interface at a terminal end thereof.

8. The wedge anchor removal device of claim 7, wherein the elongated cylindrical body is composed of steel.

9. The wedge anchor removal device of claim 7, wherein the elongated cylindrical body is composed of aluminum.

10. The wedge anchor removal device of claim 7, wherein the knurled interface comprises a lesser circumference than the rod.

* * * * *